US008951082B2

(12) United States Patent
Magnusson

(10) Patent No.: US 8,951,082 B2
(45) Date of Patent: Feb. 10, 2015

(54) DEVICE FOR INCREASING THE BUOYANCY OF A HUMAN BODY

(75) Inventor: Asa Magnusson, Falun (SE)

(73) Assignee: Quicksave AB, Nassjo (SE)

( * ) Notice: Subject to any disclaimer, the term of this patent is extended or adjusted under 35 U.S.C. 154(b) by 95 days.

(21) Appl. No.: 13/885,292

(22) PCT Filed: Dec. 13, 2011

(86) PCT No.: PCT/SE2011/051502

§ 371 (c)(1),
(2), (4) Date: May 14, 2013

(87) PCT Pub. No.: WO2012/082054

PCT Pub. Date: Jun. 21, 2012

(65) Prior Publication Data

US 2013/0244516 A1 Sep. 19, 2013

(30) Foreign Application Priority Data

Dec. 14, 2010 (SE) ..... 1051319
Mar. 3, 2011 (SE) ..... 1150195

(51) Int. Cl.
*B63C 9/08* (2006.01)
*B63C 9/15* (2006.01)
*B63C 9/18* (2006.01)

(52) U.S. Cl.
CPC ..... *B63C 9/081* (2013.01); *B63C 9/155* (2013.01); *B63C 9/18* (2013.01)
USPC ..... 441/108

(58) Field of Classification Search
USPC ..... 441/80, 87, 88, 90, 92–94, 106, 108, 441/113–119, 129, 131, 132
See application file for complete search history.

(56) References Cited

U.S. PATENT DOCUMENTS

| | | | | | |
|---|---|---|---|---|---|
| 2,165,300 | A | | 7/1939 | Peterson | |
| 2,536,847 | A | | 1/1951 | Murray et al. | |
| 3,925,838 | A | | 12/1975 | Kennedy | |
| 5,180,321 | A | | 1/1993 | Brown | |
| 5,368,512 | A | * | 11/1994 | Brown | 441/108 |
| 5,702,279 | A | * | 12/1997 | Brown | 441/108 |
| 6,036,562 | A | * | 3/2000 | Brown | 441/108 |
| 2004/0063365 | A1 | | 4/2004 | Lee | |

FOREIGN PATENT DOCUMENTS

WO 02/066320 A1 8/2002

OTHER PUBLICATIONS

International Search Report, dated Feb. 16, 2012, from corresponding PCT application.

* cited by examiner

*Primary Examiner* — Daniel V Venne
(74) *Attorney, Agent, or Firm* — Young & Thompson

(57) ABSTRACT

A device for increasing the buoyancy of a human body in water includes an inflatable tube member (1), a coupling unit (4) including a first part (8) and a second part (11), the coupling unit together with the tube member being arranged to form an endless float ring when the device is in the active state, a gas cartridge (6) having a punctureable membrane, a penetration element (23) arranged to puncture the membrane, a gas duct extending between the first part of the coupling unit and the tube member, wherein the gas cartridge and the penetration element are mutually displaceable in the direction towards each other. A first coupling member (20) of the first part is pivotally arranged about a pivot between an inactive position and an actuating position, in which the first coupling member, direct or indirect, causing the mutual displacement of the gas cartridge and the penetration element.

9 Claims, 4 Drawing Sheets

DEVICE FOR INCREASING THE BUOYANCY OF A HUMAN BODY

TECHNICAL FIELD OF THE INVENTION

The present invention relates in general to a device for increasing the buoyancy of a human body in water. The present invention relates specifically to a device that is arranged to occupy an inactive state for storage and transportation and an active inflated state when used as rescue equipment, respectively. The inventive device comprises an inflatable tube member having a first end, a second end and an intermediate gas-tight space, and a coupling unit. Wherein the coupling unit comprises a first part connected to the first end of the tube member and having a first coupling member, and a second part connected to the second end of the tube member and having a second coupling member, said coupling unit together with said tube member being arranged to form an endless float ring when the device is in the active state, a gas cartridge arrange to inflate the tube member, the gas cartridge comprising a punctureable membrane and being located in said first part of the coupling unit, a penetration element arranged to puncture the membrane of the gas cartridge, the penetration element being located in said first part of the coupling unit, and a gas duct extending between said first part of the coupling unit and the gas-tight space of the tube member. Thereto the gas cartridge and the penetration element are mutually displaceable in the direction towards each other.

BACKGROUND OF THE INVENTION

In connection with most activities near water there is a risk of drowning accidents. The outlook for rapidly being able to help a person, who has fallen into the water, decreases if the person by his own efforts cannot stay above the water surface. Devices for keeping a person floating at the water surface until a rescue mission can begin are known since long. One example is U.S. Pat. No. 2,165,300, which discloses an inflatable tube member in the shape of a belt. The belt is intended to be attached to the user during the entire activity performed near the water. The device is activated by means of a lever, which is located within the tube member. The lever is pressed and thereby a penetration element is displaced in order to puncture a membrane of a gas cartridge. The operation of the known belt requires quite delicate manipulation, which is hard when trying to activate the belt under water on a person who is struggling or who is unconscious. Thereto the belt as such is very hard to attach to a person who is already distressed and therefor the known belt is problematic and inexpedient to use as rescue equipment.

SUMMARY OF THE INVENTION

The present invention aims at obviating the aforementioned disadvantages and failings of previously known devices, and at providing an improved inflatable device. A primary object of the present invention is to provide an improved device of the initially defined type, which is easy and quick to handle in order to be brought from the inactive state to the active state during or after forming a closed ring about a distressed person to be rescued.

According to the invention at least the primary object is attained by means of the initially defined device having the features defined in the independent claim. Preferred embodiments of the present invention are further defined in the dependent claims.

According to a first aspect of the present invention, there is provided a device of the initially defined type, which is characterized in that the first coupling member is pivotably arranged about a pivot between an inactive position and an actuating position, in which the first coupling member, direct or indirect, causing the mutual displacement of the gas cartridge and the penetration element. Thereby activation of the inflatable tube member is made possible by moving the first part and the second part of the coupling unit, which are in an engaged state, in a direction away from each other or in a direction towards each other. Delicate manipulation of the device for activation thereof is not necessary.

According to a preferred embodiment of the invention the gas cartridge is displaced towards the penetration element, which is stationary.

According to yet another preferred embodiment the gas cartridge and the penetration element are mutually displaced towards each other by means of a lifter of the first coupling member, which lifter acts, directly or indirectly, against one of said gas cartridge and said penetration element. Thereby the force the user/rescuer needs to apply to active the device is decreased.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF THE INVENTION

Figure 1:
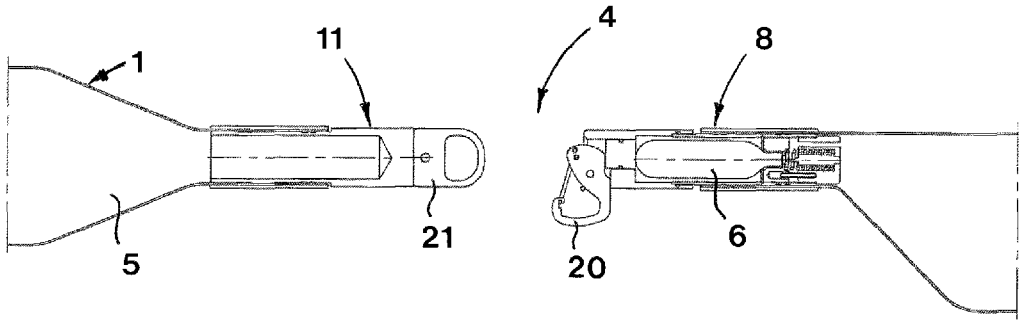
FIG. 1 is a schematic cross sectional side view disclosing the coupling unit of the device according to a preferred embodiment, when the first and second parts of the coupling unit are in unengaged state.

In FIGS. 1-6 is disclosed a preferred embodiment of the inventive device for increasing the buoyancy of a human body in water. The device is arranged to occupy an inactive state for storage and transportation and an active inflated state when used as rescue equipment, respectively. The device comprises an inflatable, expandable tube member 1, which preferably is made of an elastic material such as rubber. The tube member 1 comprises a first end 2, a second end 3 and an intermediate gas-tight space 5 extending between said first end 2 and said second end 3. Furthermore, the device comprises a coupling unit 4, which together with said tube member 1 is arranged to form an endless float ring when the device is in said active state. The coupling unit 4 comprises a gas cartridge 6 arranged to inflate the tube member 1 upon activation of the device. Said gas cartridge 6 comprises a punctureable closure 7, or membrane, which when punctured releases pressurized gas stored in a main body of the gas cartridge 6. Said gas cartridge 6 is a single use article, which must be replaced after being punctured.

The coupling unit 4 comprises a first part 8, or handle, connected to the first end 2 of the tube member 1 in a gas-tight way, and a second part 11, or handle, connected to the second end 3 of the tube member 1 in a gas-tight way. Said first part 8 of the coupling unit 4 has a coupling end 9 and an opposite tube member connection end 10, and said second part 11 of the coupling unit 4 has a coupling end 12 and an opposite tube member connection end 13.

The first part 8 of the coupling unit 4 comprises an interior space accommodating said cartridge 6 and a penetration element 23 which is arranged to puncture the membrane 7 of the gas cartridge 6, and a gas duct 22 extending between the interior space of the first part 8 of the coupling unit 4 and the gas-tight space 5 of the tube member 1, in order to let the released pressurized gas from the gas cartridge 6 to enter the gas-tight space 5 of the tube member 1 upon activation of the device.

In the preferred embodiment the first part 8 of the coupling unit 4 comprises an axially extending elongated inner sleeve 18 housing the gas cartridge 6 and the penetration element 23, and an end fitting 16 located at the coupling end 9 of the first part 8. The end fitting 16 and the inner sleeve 18 are connected to each other and they shall be mutually undisplaceable in the axial direction, and preferably the end fitting 16 is screwed onto the inner sleeve 18, in order to get access to and replace the gas cartridge 6. The first end 2 of the tube member 1 is connected to and extends from the tube member connection end 10 of the first part 8. Preferably the first part 8 comprises an axially extending outer sleeve 14, which is telescopically arranged outside the inner sleeve 18, wherein the first end 2 of the tube member 1 is located and clamped/fixed between an outer side of the inner sleeve 18 and an inner side of the outer sleeve 14.

In the preferred embodiment the second part 11 of the coupling unit 4 comprises an axially extending elongated inner sleeve and an end fitting 17 located at the coupling end 12 of the second part 11. The end fitting 17 and the inner sleeve are connected to each other and they shall be mutually undisplaceable in the axial direction, and preferably the end fitting 17 and the inner sleeve constitutes one single element. The second end 3 of the tube member 1 is connected to and extends from the tube member connection end 13 of the second part 11. Preferably the second part 11 comprises an axially extending outer sleeve 15, which is telescopically arranged outside the inner sleeve of the second part 11, wherein the second end 3 of the tube member 1 is located and clamped/fixed between an outer side of the inner sleeve and an inner side of the outer sleeve 15. The inner sleeve of the second part 11 comprises preferably an interior space arranged to accommodate the uninflated tube member 1 when the device is in the inactive state.

The first part 8 of the coupling unit 4 comprises, located at the coupling end 9 thereof, a first coupling member 20. Said first coupling member 20 is preferably connected to the end fitting 16 of the first part 8. Thereto the second part 11 of the coupling unit 4 comprises, located at the coupling end 12 thereof, a second coupling member 21. Said second coupling member 21 is preferably connected to the end fitting 17 of the second part 11. The first coupling member 20 and said second coupling member 21 are releasably connectable to each other, i.e. the first part 8 and the second part 11 of the coupling unit 4 are releasably connectable to each other by means of the first coupling member 20 and the second coupling member 21. The device may be activated, i.e. go from the inactive state to the active state, during or after interconnection of the first coupling member 20 and the second coupling member 21.

The first coupling member 20 of the first part 8 of the coupling unit 4 is pivotally arranged about a pivot 27 between an inactive position and an actuating position. The pivot 27 is arranged across the axial direction of the first part 8 of the coupling unit 4, preferably perpendicular to said axial direction. The centre axes of the gas cartridge 6 and the first part 8 of the coupling unit 4 are essentially parallel to each other, and preferably they run together.

Figure 2:
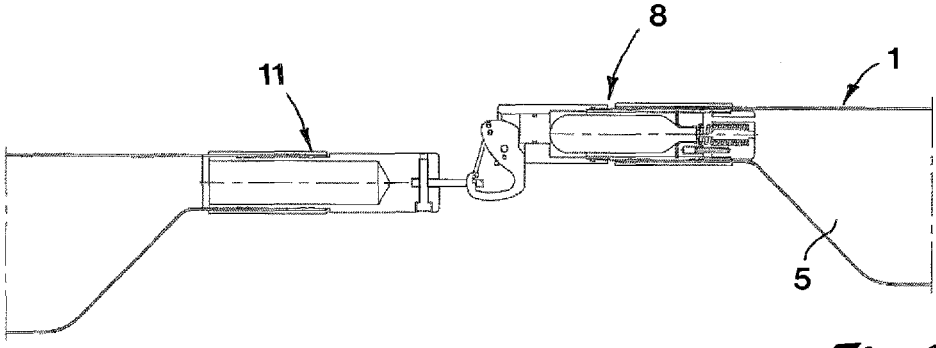
FIG. 2 is a schematic cross sectional side view disclosing the coupling unit according to FIG. 1, when the first and second parts in an engaged state before activation.
Figure 3:
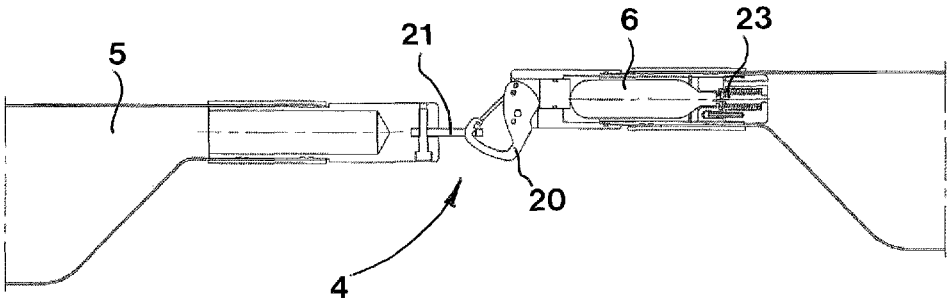
FIG. 3 is a schematic cross sectional side view disclosing the coupling unit according to FIGS. 1 and 2, when the inventive device is in the active state.
Figure 4:
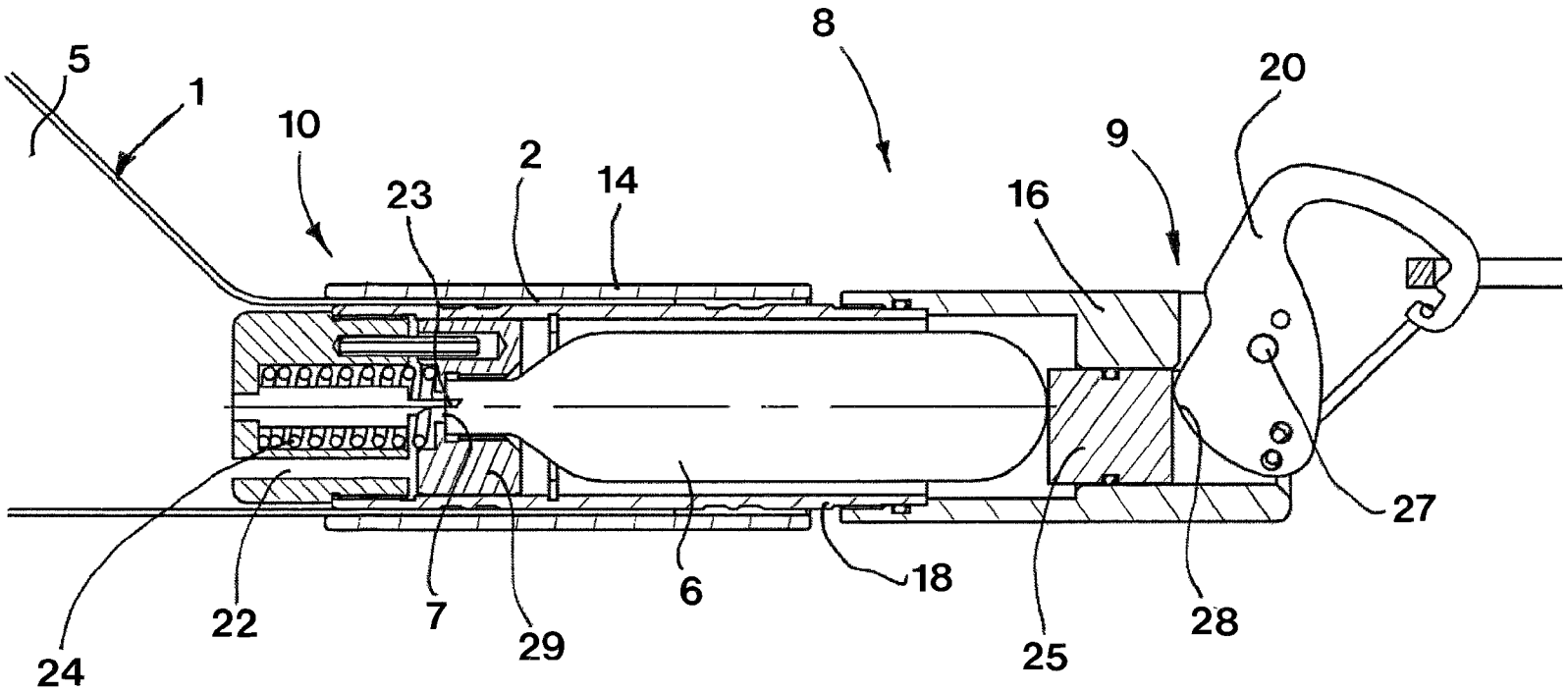
FIG. 4 is a cross sectional side view of the first part of the coupling unit, disclosing the gas cartridge and penetration element after activation.
Figure 5:
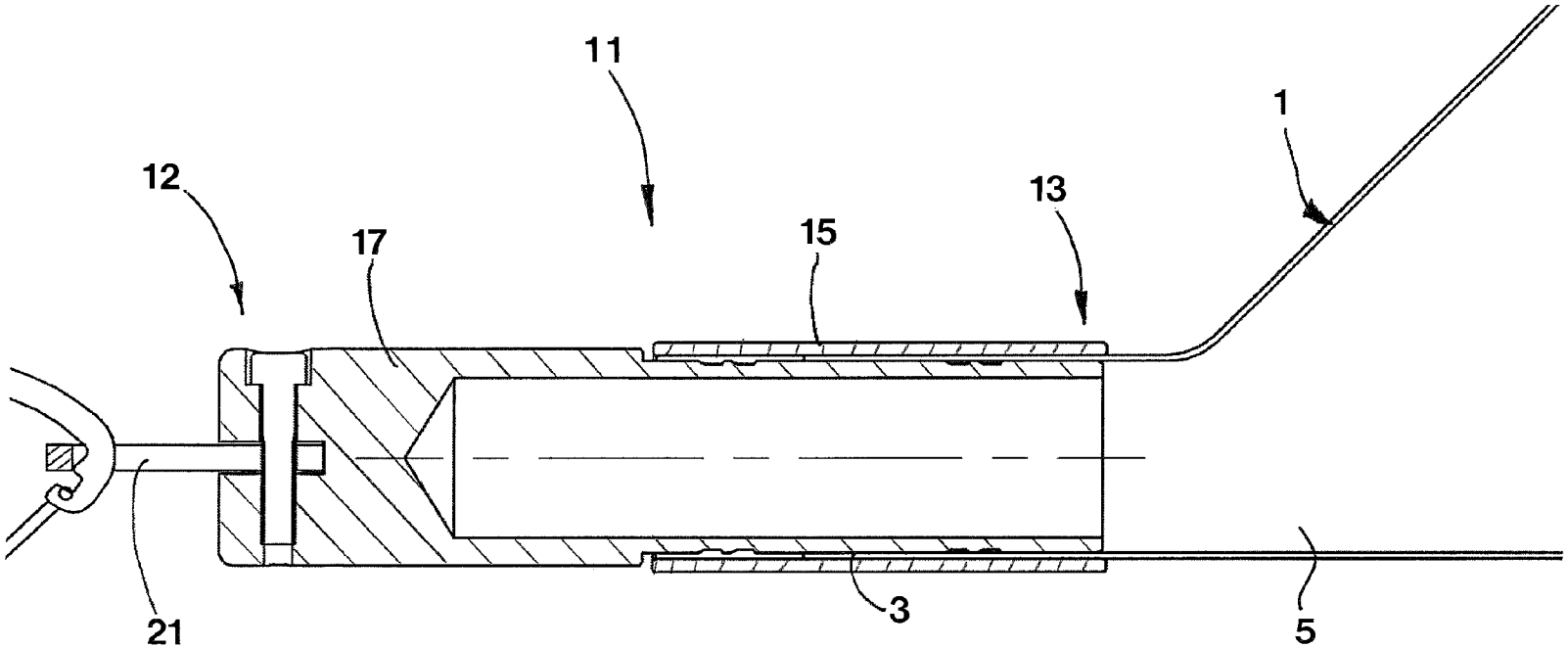
FIG. 5 is a cross sectional side view of the second part of the coupling unit.
Figure 6:
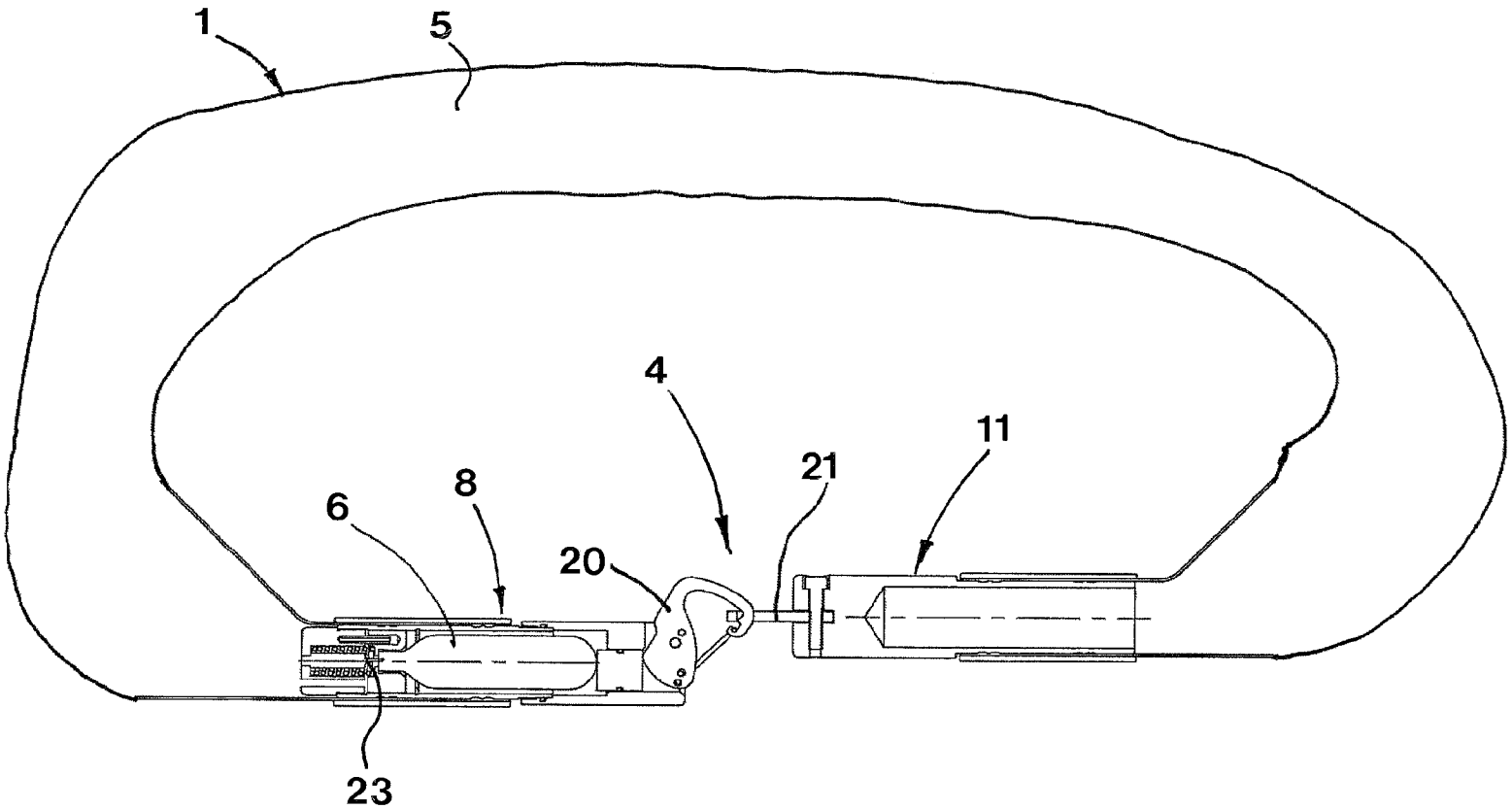
FIG. 6 is a schematic perspective view of the inventive device, in the shape of a closed float ring, when the device is in the active state.

The gas cartridge 6 is in the shown embodiment displaceable in the axial direction within the first part 8 of the coupling unit 4, from a storage position, shown in FIGS. 1 and 2, to an activated position, shown in FIGS. 3 and 4. The gas cartridge 6 is preferably connected to a runner 29, which is axially displaceable and guided within the inner sleeve 18 of the first part 8 of the coupling unit 4. Preferably an outwardly threaded neck, comprising the membrane 7, of the gas cartridge 6 is screwed into an inwardly threaded through hole of said runner 29, such that the membrane 7 of the gas cartridge 6 is accessible from the side of the runner 29 being opposite the main body of the gas cartridge 6. The gas cartridge 6 is preferably biased towards or retained in the storage position, in order to prevent the membrane 7 of the gas cartridge 6 to accidentally come into contact with the penetration element 23, i.e. by means of a spring 24, deformable projections of the inner sleeve 18 (not shown), by means of frictional force from the inner surface of the inner sleeve 18, etc. In the shown preferred embodiment of the device, the penetration element 23 is stationary. Thus, the gas cartridge 6 and the penetration element 23 are mutually displaceable in a direction towards each other. The penetration element 23 is in the shown embodiment connected to a holder which in its turn is connected to the inner sleeve 18 of the first part 8 of the coupling unit 4. Said holder separate the interior side of the first part 8 of the coupling unit 4 from the gas-tight space 5 of the tube member 1, and said holder may comprise said gas duct 22.

The first coupling member 20 of the first part 8 of the coupling unit 4 is arranged to cause, direct or indirect, mutual displacement of the gas cartridge 6 and the penetration element 23, by being turnable about said pivot 27. In the shown embodiment said first coupling member 20 will cause axial displacement of the gas cartridge 6 when the first coupling member 20 is moved from the inactive position (shown in FIGS. 1 and 2) to the actuating position (shown in FIGS. 3 and 4). The first coupling member 20 may act either directly against the gas cartridge 6 or via an intermediate member, such as an axially displaceable plug 25. Said plug 25 is also arranged to seal the interior side of the first part 8 of the coupling unit 4 from the surrounding atmosphere. In the absence of such a plug 25, the interior side of the first part 8 of the coupling unit 4 most be sealed off in another appropriate way, i.e. at the interface between the gas cartridge 6 and the runner 29 and at the interface between the runner 29 and the inner sleeve 18 of the first part 8 of the coupling unit 4.

The first coupling member 20 of the first part 8 of the coupling unit 4 comprises in the shown embodiment a lifter 28, or cam surface, i.e. the peripheral surface of the first coupling member 20 has a varying distance in relation to said pivot 27, and the ridge of the lifter 28 will move in the axial direction towards the gas cartridge 6 when the first coupling member 20 is turned about the pivot 27. The lifter 28 is arranged on the side of the first coupling member 20 that is located between the gas cartridge 6 and the pivot 27, when the first coupling member 20 is in the actuating position. When the first coupling member 20 is in the inactive position the lifter 28 does not displace the gas cartridge 6 from the storage position thereof.

Thus, when the first coupling member 20 turn about the pivot 27 the lifter 28 will, direct or indirect, engage the gas cartridge 6 and cause a displacement thereof towards the penetration element 23, i.e. the gas cartridge 6 is displaced from the inactive position to the active position thereof.

Preferably the first coupling member 20, on the side that is located essentially opposite the lifter 28 in relation to the pivot 27, comprises an eye, a carbine hook, a snap connection, or the like, which is detachably connectable to a corresponding carbine hook, an eye, a snap connection, or the like of the second coupling member 21 of the second part 11 of the coupling unit 4.

Simultaneously with or after the first coupling member 20 and the second coupling member 21 are connected to each other the first part 8 and the second part 11 shall be pulled in a direction from each other, in order to turn the first coupling member 20 about the pivot 27 from the inactive position to the actuating position thereof. Thereby the gas cartridge 6 will be displaced from the inactive position to the active position thereof, and the penetration element 23 will puncture the membrane 7 of the gas cartridge 6. When the membrane 7 is punctured the pressurized gas is released and the gas will enter the gas-tight space 5 of the inflatable tube member 1 via the gas duct 22, in order to inflate the tube member 1.

It shall be realized that another configuration of the first coupling member 20 will admit that the first part 8 and the second part 11 may be pushed in a direction towards each other, in order to turn the first coupling member 20 from the inactive position to the actuating position thereof.

In an alternative embodiment (not shown), the gas cartridge 6 and the penetration element 23 may change places, wherein the penetration element 23 is displaceable in the axial direction and the gas cartridge 6 is stationary. Thus, the first coupling member 20 is in, direct or indirect, engagement with the penetration element 23 located between the gas cartridge 6 and the first coupling member 20.

In an alternative embodiment (not shown) the gas cartridge 6 is stationary and located between the penetration element 23 and the first coupling member 20, wherein the penetration element 23 is displaceable in a direction towards the gas cartridge 6 and the first coupling member 20. In such a case a turn of the first coupling member 20 about the pivot 27 will be transferred via a wire, or the like, to the penetration element 23 or its holder. In an alternative embodiment the gas cartridge 6 and the penetration element 23 may change places, such that the penetration element 23 is located between the gas cartridge 6 and the first coupling member 20 and the gas cartridge 6 is displaced in a corresponding way.

In another embodiment (not shown), which is a mix of the embodiments above, both the gas cartridge 6 and the penetration element 23 are displaceable in a direction towards each other.

It shall also be pointed out that the device may comprise two handles of the type of the first part 8 of the coupling unit 4, instead of one handle of the type of the first part 8 and one handle of the type of the second part 11. Thus, such a coupling unit 4 comprises two gas cartridges 6, two penetration elements 23, two first coupling members 20, etc.

The component parts of the first part 8 and of the second part 11 of the coupling unit 4, are preferably made out of metal, e.g. aluminum, or made out of a suitable plastic.

In order to rescue a person, who is located in the water at or under the water surface, the device is applied around the torso of the person, below the arms. The first coupling member 20 and the second coupling member 21 are interconnected and the device, i.e. the gas cartridge 6, is activated by pulling the first part 8 and the second part 11 of the coupling unit 4 in a direction away from each other, whereupon the first coupling member 20 turns about the pivot 27, the membrane 7 of the gas cartridge 6 is punctured by the penetration element 23, and the tube member 1 is inflated. Thereby the device increases the buoyancy of the person, and the person will be brought to and kept at the water surface.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

It shall also be pointed out that even thus it is not explicitly stated that features from a specific embodiment may be combined with features from another embodiment, the combination shall be considered obvious, if the combination is possible.

The invention claimed is:

1. Device for increasing the buoyancy of a human body in water, the device being arranged to take an inactive state for storage and transportation and an active inflated state, respectively, the device comprising:

an inflatable tube member (1) having a first end (2), a second end (3) and an intermediate gas-tight space (5), a coupling unit (4), comprising a first part (8) connected to the first end (2) of the tube member (1) and having a first coupling member (20), and a second part (11) connected to the second end (3) of the tube member (1) and having a second coupling member (21), said coupling unit (4) together with said tube member (1) being arranged to form an endless float ring when the device is in the active state, a gas cartridge (6) arrange to inflate the tube member (1), the gas cartridge (6) comprising a punctureable membrane (7) and being located in said first part (8) of the coupling unit (4), a penetration element (23) arranged to puncture the membrane (7) of the gas cartridge (6), the penetration element (23) being located in said first part (8) of the coupling unit (4), and a gas duct (22) extending between said first part (8) of the coupling unit (4) and the gas-tight space (5) of the tube member (1), wherein the gas cartridge (6) and the penetration element (23) are mutually displaceable in the direction towards each other, characterized in that the first coupling member (20) is pivotally arranged about a pivot (27) between an inactive position and an actuating position, in which the first coupling member (20), direct or indirect, causing said mutual displacement of the gas cartridge (6) and the penetration element (23).

2. Device according to claim 1, wherein the gas cartridge (6) is displaceable in the axial direction and the penetration element (23) is stationary.

3. Device according to claim 1, wherein the gas cartridge (6) is stationary and the penetration element (23) is displaceable in the axial direction.

4. Device according to claim 1, wherein the first coupling member (20) of the first part (8) of the coupling unit (4) comprises a lifter (28), acting directly or indirectly against one of said gas cartridge (6) and said penetration element (23).

5. Device according to claim 1, wherein the first part (8) of the coupling unit (4) comprises a plug (25) that is displaceable in the axial direction under the action of the first coupling member (20) and that seal off an interior side of the first part (8) of the coupling unit (4) from the atmosphere.

6. Device according to claim 2, wherein the first coupling member (20) of the first part (8) of the coupling unit (4) comprises a lifter (28), acting directly or indirectly against one of said gas cartridge (6) and said penetration element (23).

7. Device according to claim 3, wherein the first coupling member (20) of the first part (8) of the coupling unit (4) comprises a lifter (28), acting directly or indirectly against one of said gas cartridge (6) and said penetration element (23).

8. Device according to claim 2, wherein the first part (8) of the coupling unit (4) comprises a plug (25) that is displaceable in the axial direction under the action of the first coupling member (20) and that seal off an interior side of the first part (8) of the coupling unit (4) from the atmosphere.

9. Device according to claim 3, wherein the first part (8) of the coupling unit (4) comprises a plug (25) that is displaceable in the axial direction under the action of the first coupling member (20) and that seal off an interior side of the first part (8) of the coupling unit (4) from the atmosphere.

* * * * *